US005522627A

United States Patent [19]

Swift

[11] Patent Number: 5,522,627

[45] Date of Patent: Jun. 4, 1996

[54] SECURITY SEAL

[75] Inventor: Allan W. Swift, Denville, N.J.

[73] Assignee: E. J. Brooks, Inc., Newark, N.J.

[21] Appl. No.: 272,253

[22] Filed: Jul. 8, 1994

[51] Int. Cl.[6] ..... B65D 27/30

[52] U.S. Cl. ..... 292/319; 292/307 R

[58] Field of Search ..... 292/319, 307 A, 292/307 R, 316–322

[56] References Cited

U.S. PATENT DOCUMENTS

| | | | |
|---|---|---|---|
| 3,712,655 | 1/1973 | Fuehrer | 292/321 |
| 3,717,369 | 2/1973 | Stoffel et al. | 292/322 X |
| 3,830,538 | 8/1974 | Moberg | 292/322 |
| 4,229,031 | 10/1980 | Guiler | 292/322 |
| 4,319,776 | 3/1982 | Moberg | 292/322 |
| 4,506,921 | 3/1985 | Swift | 292/318 |
| 4,586,570 | 5/1986 | Swift | 292/322 X |

FOREIGN PATENT DOCUMENTS

| | | | |
|---|---|---|---|
| 2551029 | 5/1977 | Germany | 292/317 |

*Primary Examiner*—Steven N. Meyers
*Assistant Examiner*—Monica E. Millner
*Attorney, Agent, or Firm*—William Squire

[57] ABSTRACT

A pair of aligned tandemly attached locking elements are cantilevered from a stud and a socket are hinged together to be placed in an engaged first locking mode with the outermost one of the locking elements. The elements are secured to the stud such that an axial separating force on the stud and socket for disengaging the locked engagement causes the engaged locked element to sever from the seal, and the other second intermediate element remains attached to the stud so the seal can be used with the second element in a second locking mode. A stop is provided for preventing insertion of the second intermediate locking element into engagement with the socket in a lock condition when the first locking element is attached to the stud and locked to the socket.

18 Claims, 3 Drawing Sheets

SECURITY SEAL

This invention relates to security seals, and more particularly, to multiple use thermoplastic seals for providing tamper evidence.

In U.S. Pat. No. 4,319,776 issued Mar. 16, 1982 a security seal is disclosed comprising a single thermoplastic member having a pair of resilient legs mounted on a base and carrying on their free ends respective locking stud and socket members adapted to be locked when engaged when the legs are flexed together. An additional spring is between the legs and is flexed when the legs are flexed together. If the stud is not securely locked, the spring and flex forces of the flexed legs separates the legs if the stud is not securely locked to the socket.

A similar arrangement is disclosed in U.S. Pat. No. 4,506,921 wherein in place of resilient legs, a movable leg is hinged to a rigid base from which extends a non-movable leg. A tension spring extends around the outside of the hinge and is joined at the ends to adjacent portions of the movable leg and the base. The spring forces the legs apart when the stud is not securely locked opening the seal.

In both of the above structures the stud is unlocked by severing the stud from its associated leg providing tampering evidence. In the '921 patent the stud has an arrowhead shaped tip with a transverse shoulder adjacent to a reduced cross section area attached to the associated leg. A manual force applied to the legs to separate them causes the arrowhead tip to break free from the rest of the stud. Once this happens the seal is no longer useful, providing tamper evidence.

The present inventor recognizes a need in the above seals for an arrangement wherein the seal is reusable. The above seals need to be discarded once the locked studs are severed.

A one-piece thermoplastic security seal according to an embodiment of the present invention comprises first and second legs each having proximal and distal ends, the distal ends being spaced apart; means for coupling the proximal ends; cooperating engaging locking means secured to the distal ends of the legs for locking engagement with each other, one of the cooperating means comprising a first male member with a locking element on one leg and the other cooperating means comprising a female member on the other leg for receiving the first male member locking element in locking engagement therewith; at least one of the first and second legs and means for coupling are arranged so that the distal ends of the legs can be manually pushed together, the legs being so positioned and dimensioned such that when pushed together, the locking element enters into the locking engagement with the female member, the first male member when severed in a region between the locking element and the one leg distal end unlocks the one leg from the other leg at the distal ends; and a second male member attached to the one leg including a second locking element adjacent to the first male member and cooperating with the female member to lock to the female member upon severing the locked first locking element from the one leg.

In a further embodiment, the second male member extends from and proximal the one leg distal end along an axis, the first male member extending from the second male member distal the leg relative to the second male member along the axis.

In a further embodiment, the locking elements are tandemly attached such that an axial force on the elements to disengage the locked outermost element severs only that element from the seal with the other intermediate element remaining attached to the one leg.

In a still further embodiment, stop means are secured to at least one of the legs for stopping further insertion of the first locking element into the female member after locking engagement of the first element with the female member to preclude insertion of the second locking element into locking engagement with the female member.

IN THE DRAWING

Figure 1:
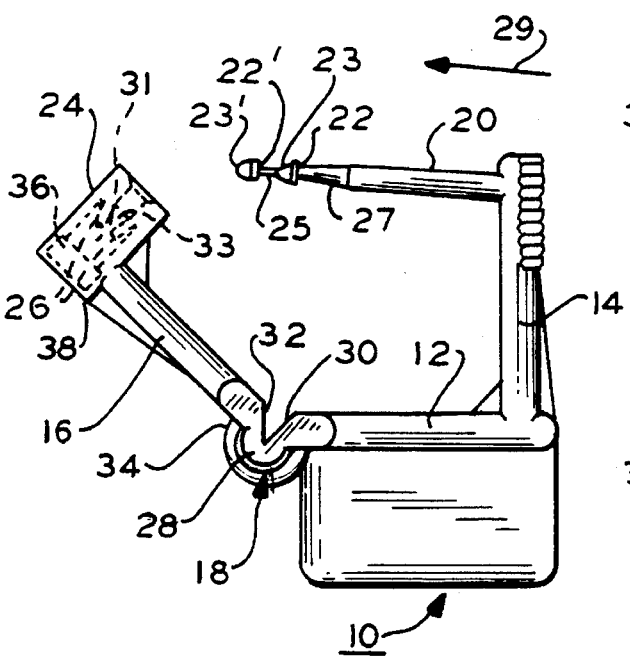
FIG. 1 is an elevation side view of a seal in accordance with one embodiment of the present invention having multiple lock capabilities.

In FIG. 1, seal 10, which is preferably molded thermoplastic formed as one piece, comprises a rigid base 12, a relatively non-movable rigid leg 14 upstanding from one end of the base 12 and a movable flexible leg 16 hinged to the base 12 other end by hinge 18. The leg 16 normally diverges from the fixed leg 14 in its quiescent state as shown. A tension spring 34 is external hinge 18 and is coupled at its ends to leg 16 and base 12. The spring 36 urges the legs to the state shown when they are manually forced into the locking state of FIG. 2, to be described below. This structure is generally shown in U.S. Pat. No. 4,506,921 incorporated by reference herein.

Extending cantilevered from the end of leg 14 distal the base 12 is a relatively stiff circular cylindrical stud member 20 which has transverse locking shoulders 22 and 22' formed from respective corresponding tapered arrowhead shaped locking elements 23 and 23'. The shoulders 22 and 22' are formed by reduced diameter cylindrical portion 25 and conical portion 27, respectively, formed in member 20. The elements 23 and 23' are aligned coaxially and are tandem with respect to each other with the locking element 23' cantilevered from element 23 and being endmost distal the leg 14. The element 23 is intermediate the element 23' and the inner portion of the stud member 20 attached to leg 14. Except for element 23' and portion 25, leg 14 and stud member 20 may be identical to the corresponding structure in U.S. Pat. No. 4,506,921.

The elements 23 and 23' are so attached to respective portions 27 and 25 that an axial force in direction 29 of a first given magnitude on the elements 23 and 23' away from leg 14, which is relatively stiff, only severs the element 23' from portion 25 while the element 23 remains attached to the portion 27. This provides a first lock release action.

The portion 25 is of smaller diameter than smallest diameter of conical portion 27 at shoulder 22 to obtain this sequence of action. An axial force on leg 16 relative to leg 14 in direction 29 and of a greater second magnitude than the first magnitude is used to then separate locked element 23 from portion 27 at shoulder 22 in a subsequent locking release action to be described below.

This severance sequence is important because in order to provide a dual locking use for the seal 20 in a manner to be explained, the innermost locking element 23 must remain attached to stud member 20 when the element 23' is subject to an axially directed lock release severance force in direction 29. Thus, when the second magnitude force is initially applied to the element 23', element 23' separates at shoulder 22' before the second greater force magnitude level would be applied to element 23.

Element 23 always remains intact with the element 23' present. Therefore, the thickness of the attaching portions 25 and 27 for the locking elements 23' and 23 is respectively greater in a direction toward the leg 14. In an alternative embodiment, more than two locking elements 23 may be tandemly provided as long as their attachment to the stud member is through progressively respectively increasing thicknesses of the attaching portions in a direction toward leg 14 as described.

A socket 24 is secured to the free extended end of leg 16 distal base 12 and hinge 18. The socket 24 has a locking cavity 31 and an opening 33 in communication with the cavity 31 for receiving the stud member 20 locking elements 23 and 23'. The socket 24 has internal flexible locking fingers 26 dimensioned to resiliently receive the locking elements 23 and 23' therethrough. When the locking element 23' enters the cavity 31 it radially expands the fingers 26 which then snap back after the shoulder 22 passes the fingers 26, locking the element 23' in the cavity 31 at shoulder 22. In similar fashion, the locking element 23 is also locked to fingers 26 when the element 23' is severed in a second locking action. A socket similar to socket 24 is further described in the aforementioned U.S. Pat. No. 4,506,921.

A thermoplastic disc 36 is secured within cavity 31 for example by heat sealing to the peripheral wall 38 of the socket 24. Disc 36 serves an important function. When the first locking element 23' is inserted into cavity 31, it eventually will abut the disc 36 preventing further insertion of the element 23'. At the point where element 23' abuts the disc 36, FIG. 2, the second locking element 23 does not engage the fingers 26 in a locking mode. Thus only locking element 23' can be locked in an initial insertion of the member 20 into the socket 24 cavity 31.

This action is important because this action preserves the integrity of the element 23 attachment to the stud member 20 for future use in a second locking action. The position of the disc 36 is such as to provide this action. The particular form of the stud and socket illustrated is by way of example as other forms of locking studs and sockets using the principles enumerated herein may be employed in alternative embodiments. The important aspect is that the locking elements can be locked and severed one at a time and that a first locking mode needs to be disengaged before the second locking mode may be implemented employing tandem connected locking elements with a single socket.

The hinge 18 and tension spring 34 are as described in the aforementioned patent '921 incorporated by reference herein and need not be described further. Briefly, the hinge 18 has a medial web portion 28. The spring 34 is semicircular to provide an opening force to the movable leg 16 when the member 20 is engaged with the socket 24 in the locking mode of FIG. 2. If the stud 20 is not securely locked to the socket, the leg 16 will be rotated to the position of FIG. 1 by the spring action of spring 34, the stud 20 backing out of the cavity 31 of the socket 24.

A flat surface 30 is provided base 12 and a mating flat surface 32 is provided leg 16. The seal 10 when molded appears as in FIG. 1, with the flat surfaces extending from an apex at an acute angle at medial portion 28. When leg 16 is rotated so the socket 24 engages the stud member 20, the flat surfaces bear against each other before the stud member 20 is locked in the socket 24. Therefore, to effect the locking action, the leg 16 must be flexed toward stud member 20. The flexed leg 16 provides further spring-back force to the leg 16.

Figure 2:
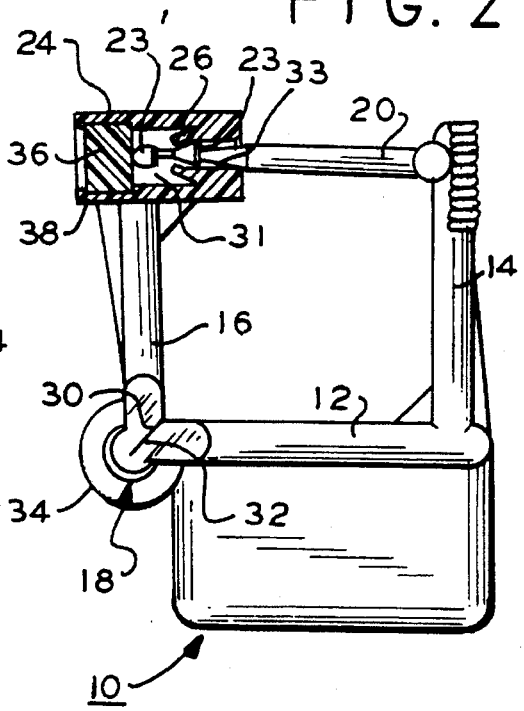
FIG. 2 is a side elevation partially in section of the seal of FIG. 1 showing a fully inserted locking element stopped by a stop in an initial locking condition.

In operation, the stud member 20 locking element 23' is inserted into the cavity 31 of the socket and locked to the fingers 26 via the shoulder 22', FIG. 2. The element 23' during the insertion abuts the disc 36 so that element 23 can not engage or lock to the fingers 26.

When it is desired to unlock the seal, the leg 16 is manually forced in a counterclockwise direction about hinge 18 in FIG. 2. This action produces an axial force on the element 23' due to its locked engagement with the fingers 26. This force separates the portion 25 from the locking element 23 at the junction therebetween due to the reduced transverse dimension at this location. A notch may be provided portion 25 at this location to further assist the fracturing. The separated element 23' remains in the cavity 31, FIG. 3, and the leg 16 is resiliently forced to return to its quiescent position by spring 34 and the flexure forces in leg 16.

Figure 4:
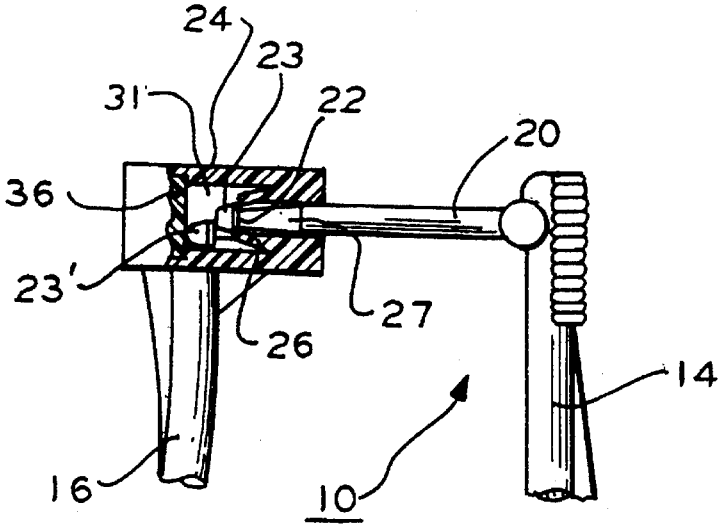
FIG. 4 is a side fragmented elevation view partially in section of the seal of FIG. 3 in a second locked condition.

In FIG. 4, in a second locking action, the locking element 23 is manually engaged with and locked to the fingers 26 in the cavity 31. The prior element 23' in the cavity 31 does not interfere with the locking action of the second element 23. When it is desired to unlock the seal a separating force is applied to the stud member 20 and socket 24 until the locking element 23 separates at the reduced transverse region at the shoulder 22. In this way one seal 10 has multiple uses.

Figure 5:
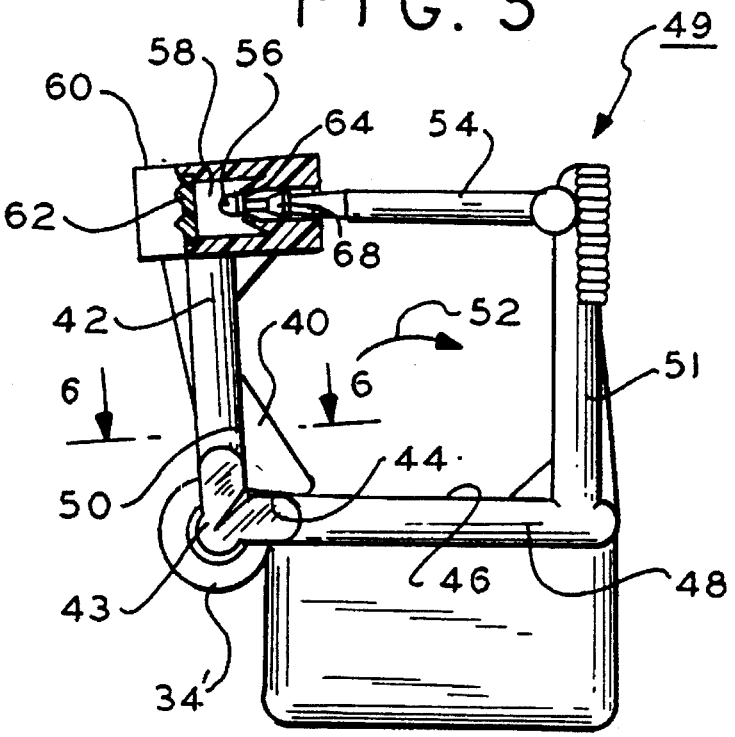
FIG. 5 is a side elevation view partially in section of a seal according to a second embodiment of the present invention in an initial locked condition.

In FIG. 5, an alternative embodiment of a seal is shown. In FIG. 5, seal 49 has a stud member 54, identical to stud member 20, FIG. 1, a base 48 to which is hinged leg 42 via hinge 43 and a leg 51 secured to base 48 from which stud member 54 is cantilevered. These elements are substantially the same as similar elements in the embodiment of FIG. 1. A socket 60 is secured to the distal end of the leg 42. The socket has a disc 62 and locking fingers 64 similar to fingers 26, FIG. 1 in locking cavity 58.

In addition, a stop flange 40 is molded integral with movable leg 42 corresponding to leg 16, FIG. 1. The flange 40 is triangular in side elevation view as shown so that one edge surface 44 can abut facing surface 46 of base 48. Edge 50 of flange 40 is molded integral with leg 42. The flange 40 limits the rotation displacement of leg 42 in direction 52 relative to the stud member 54. This limits the insertion of the endmost locking element 56 into cavity 58 of socket 60. This is similar to the function of disc 36 in the embodiments of FIGS. 1–4.

Disc 62 is sealed to the socket 60 and seals the cavity 58 at an end opposite the fingers 64. Disc 62 does not stop the insertion of the element 56 in this embodiment. The insertion of the element 56 is stopped prior to the element 56 reaching the disc 62 by the engagement of the flange 40 surface 44 with the base 48 surface 46.

Figure 6:
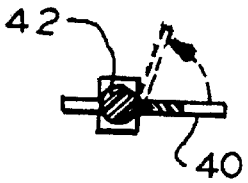
FIG. 6 is a sectional view taken along lines 6—6 of FIG. 5.

In operation, when it is desired to reuse the seal, the locking engagement of FIG. 5 is broken in a manner described above in the embodiments of FIGS. 1–4. This severs the endmost locking element 56 from the stud member 54. When it is desired to lock the second element 68 in a second use of the seal 49, the flange 40 is rotated as shown in phantom, FIG. 6. In this position, the flange 40 no longer can engage the surface 46 of base 48 when the intermediate locking element 68 is inserted in the cavity 58 in locking engagement with the fingers 64. The flange is rotated sufficiently so that it can not abut: the surface 46 of base 48 in a manner to preclude insertion of the intermediate locking element 68 in locking engagement with the fingers 64. In the alternative, the flange 40 may be removed entirely. A living hinge may be provided the junction of the flange 40 with the leg 42 to facilitate the flange rotation.

Figure 3:
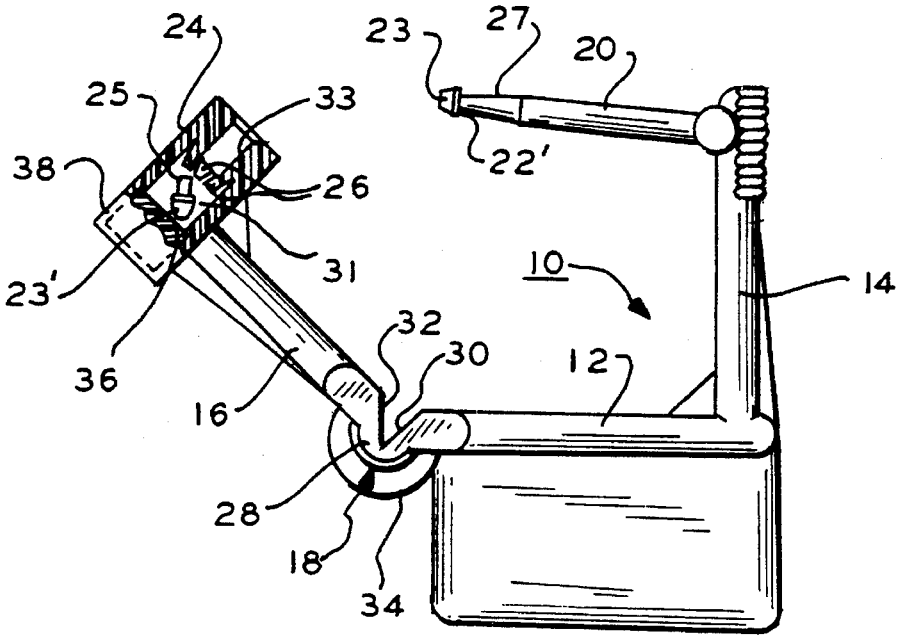
FIG. 3 is a side elevation view of the seal of FIG. 2 in the unlocked condition subsequent to the locked condition of FIG. 2.
Figure 7:
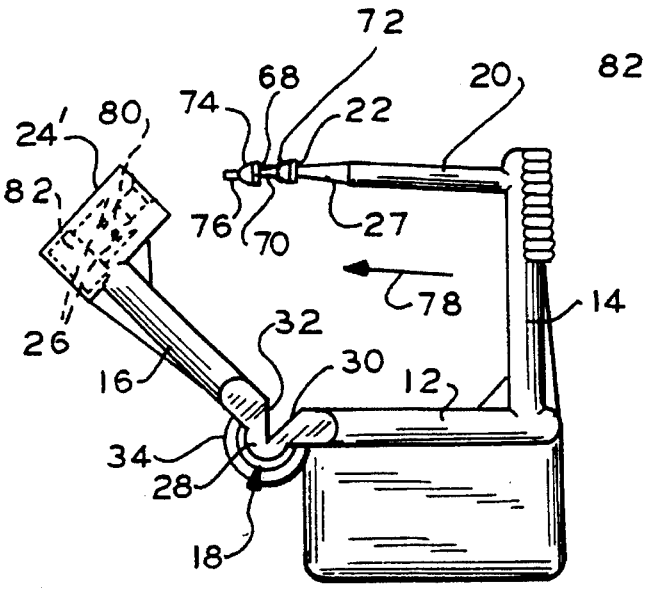
FIGS. 7, 8 and 9 are side elevation views similar to the respective views of FIGS. 1, 2 and 3 of a third embodiment of the present invention.
Figure 8:
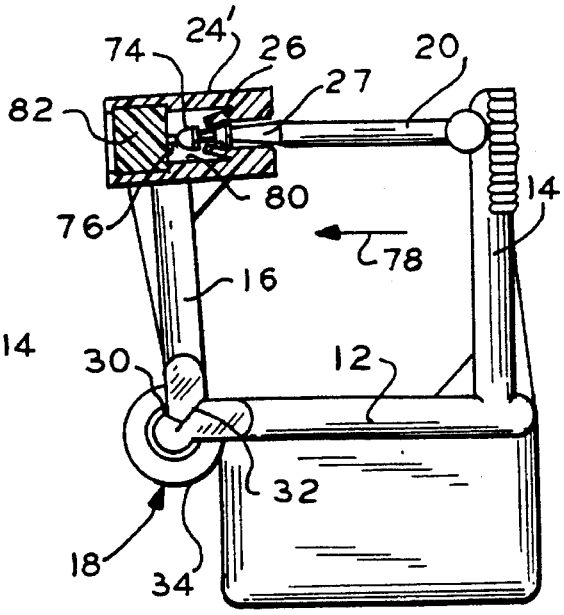
Figure 9:
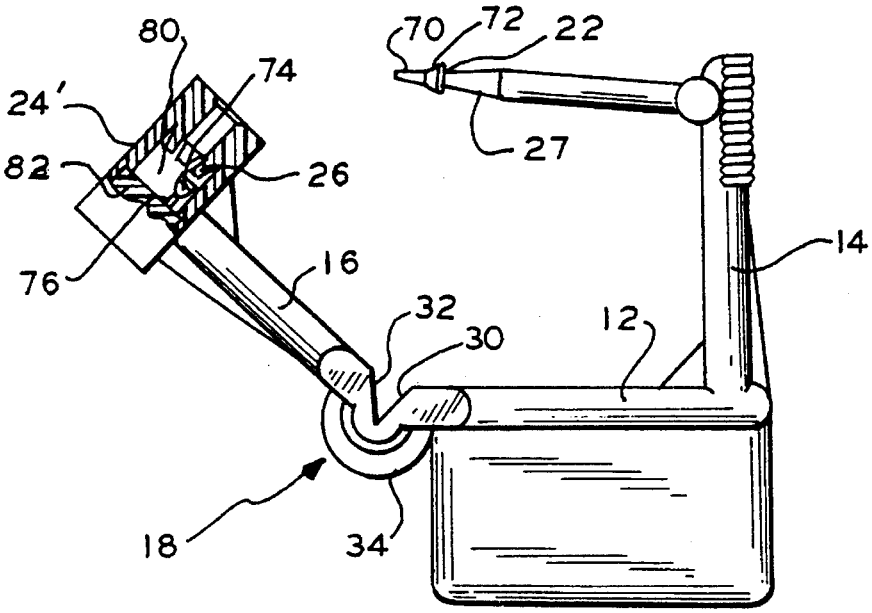

In FIGS. 7, 8 and 9, like reference numerals refer to like elements in corresponding respective FIGS. 1, 2 and 3. In FIG. 7, the stud member 20 includes two locking shoulders 22 and 68. Shoulder 22 is formed by conical portion 27 extending from the stud member 20. Shoulder 68 is formed by conical section 70 extending from the tip of tapered arrowhead shaped locking element 72. A second locking element 74 is cantilevered from the narrow tip end of section 70. A circular cylindrical tip portion 76 extends cantilered from the tip of element 74.

The portion 27 where it joins element 72 shoulder 22 is larger in diameter than the section 70 where this section joins element 74 shoulder 68. Thus, for a given axial force on section 74 in direction 78, element 74 will sever first from section 70 at the junction therebetween. Element 72 will remain attached to portion 27. Upon imposition of a second axial force in direction 78 of sufficient magnitude, the element 72 will sever from portion 27 at the junction therebetween.

The socket 24' has a locking cavity 80. A thermoplastic disc 82 is attached to the socket 24' in cavity 80 by heat welding or with an adhesive or the like. The locking cavity 80 receives the first locking element 74 and tip portion 76 in direction 78, FIG. 8. The end of portion 76 abuts the disc 82 to preclude insertion of the second element 72 in locking engagement with the locking fingers 26. This is shown in FIG. 8. The disc 82 may be the same distance from the fingers 26 in this embodiment as the disc 36 in FIGS. 1–3. In this case, the combined length of the section 76 and element 74 in direction 78 are the same as the combined length of the element 23 and portion 25, FIG. 1, direction 29.

By manually separating the legs 14 and 16, FIG. 9, the element 74 is severed by an axial force at the relatively narrower junction with stud section 70 at shoulder 68. The legs 14 and 16 return to the quiescent state of FIG. 9. The element 74 and section 76 attached thereto remain in cavity 80 out of the way of insertion of the next locking element 72 and its attached section 70 in a second locking mode.

In the second locking mode, the section 70 and element 72 are inserted into cavity 80 until locked by fingers 26 at shoulder 22. When the legs 14 and 16 are again separated, the element 72 severs from the conical portion 27 at the junction therebetween at shoulder 22.

It will occur to one of ordinary skill that various modifications may be made to the disclosed embodiments. For example, the leg 14 may be flexible and the leg 16 rigid. Also, both legs may be rigid with relative flexibility therebetwen provided by hinge 18. It is intended that the description is given by way of example only and that the scope of the invention is as defined in the appended claims.

What is claimed is:

1. A one-piece thermoplastic security seal comprising:

first and second legs each having proximal and distal ends, the distal ends being spaced apart;

means for coupling the proximal ends;

first and second cooperating engaging locking means respectively secured to the distal ends of the first and second legs for locking engagement with each other, said first cooperating means comprising a first male member with a first locking element on the first leg distal end and the second cooperating means comprising a female member on the second leg distal end for receiving the first locking element in locking engagement therewith, the first male member being severable relative to said first leg in response to a leg separation force applied to said distal ends when the locking means are engaged due to a reduced thickness region connecting the first male member and the remainder of the first leg;

at least one of the first and second legs and means for coupling being arranged so that the distal ends can be manually pushed together, the first and second legs being so positioned and dimensioned such that when pushed together, the first locking element enters into the locking engagement with the female member, the first male member when severed in the region between the first locking element and the first leg distal end unlocks the first leg from the second leg at said distal ends;

a second male member attached to the first leg including a second locking element adjacent to the first male member and cooperating with the female member to lock to the female member upon severing the locked first locking element from the first leg;

the second male member extending from and proximal the first leg distal end along an axis, the first male member extending in tandem from the second male member distal the leg relative to the second male member along the axis; and stop means secured to at least one of said first and second legs for stopping further insertion of the first locking element into the female member after locking engagement of the first locking element with the female member to preclude insertion of the second locking element into locking engagement with the female member.

2. The seal of claim 1 wherein the second male member includes a first reduced transverse region next adjacent to and secured to the first leg and the first male member includes a second reduced transverse region secured to the second male member, the second transverse region being smaller than the first region so that the first element separates relative to the second member in response to a given axial separating force on said locking elements.

3. The seal of claim 1 wherein the female member has a cavity with a locking element receiving opening for receiving such first and second locking elements for insertion into the cavity through the opening, the stop means comprising a wall in the cavity for abutting the received first locking element.

4. The seal of claim 1 wherein one of said legs has a first surface adjacent to and facing the other leg, said stop means comprising a flange member extending from the other leg in a stop orientation to prevent said further insertion, said flange member abutting the first surface in the stop orientation when the first locking element is locked to the female member.

5. The seal of claim 4 wherein the flange member is arranged so that the flange member can be displaced from the stop orientation to permit insertion of the second locking element into the female member for locking engagement therewith.

6. The seal of claim 1 wherein each male member comprises a locking head having a tapered tip portion extending away from its corresponding one leg and a transversely extending relatively larger locking shoulder, the locking shoulder of the second male member extending from the tapered tip portion of the first male member.

7. The seal of claim 1 wherein the female member has a locking cavity for receiving the first and second locking elements, said locking cavity receiving and containing the severed first locking element, the cavity being arranged to permit engagement of the second locking element in the cavity when the severed first element is in the cavity.

8. The seal of claim 3 wherein the first male member has a projecting tip portion extending from the first locking element, said tip portion being positioned to abut the wall for stopping further insertion of the first male member into the female member.

9. A one-piece thermoplastic seal comprising:

first and second legs;

means coupled to the first and second legs and arranged so that one end of each of the first and second legs can be resiliently moved together;

a socket on the one end of one leg;

first and second serially aligned locking studs on the one end of the other leg, the second stud being in a terminal endmost position and the first stud being intermediate the second stud and the other leg, the studs and socket being dimensioned and positioned for locking engagement when the first and second legs are moved together such that only the endmost second stud can be lockingly engaged with the socket in a first locking mode, the second stud being dimensioned relative to a reduced thickness section connecting the first and second studs so that the second stud is severable from the first stud in response to a leg separation force for separating said first and second legs to place the first stud in the terminal endmost position and permit the first stud to then engage the socket in a second subsequent locking mode; and stop means secured to at least one of said first and second legs for precluding engagement of the first stud with the socket while the second stud is in the endmost position.

10. The seal of claim 9 wherein the socket has a cavity for receiving a stud in the locking engagement, the socket including a stop wall in the cavity for abutting the received second stud to preclude locking engagement of the first stud.

11. The seal of claim 9 wherein the stop means includes a flange member secured to one of said first and second legs arranged to abut the other of said first and second legs in a first flange position when the first and second legs are moved together and the second stud is in locking engagement in the socket, said flange being arranged to be displaced to a second flange position to permit the first stud to enter the socket in locking engagement therewith after the second stud is severed.

12. The seal of claim 9 including hinge means for resiliently securing the first and second legs to each other.

13. The seal of claim 9 wherein the means coupled to the first and second legs includes a medial portion between the first and second legs and at least one of the first and second legs is dimensioned so that the at least one leg is flexible relative to the medial portion.

14. The seal of claim 10 wherein the cavity is dimensioned so as to receive and contain the severed second stud while in the locked engaged condition with the first stud.

15. A one-piece thermoplastic seal comprising:

first and second legs each having first and second ends;

the first end of one leg including a base portion;

resilient hinge means coupled to the first end of the other of the first and second legs and to the base position, said hinge means being arranged so that the second end of the one leg can be manually displaced toward the second end of the other leg;

a socket on the second end of the first leg;

first and second serially axially aligned male locking means secured to the second end of the second leg, the second locking means being in a terminal endmost position and the first locking means being intermediate the second locking means and the second leg, the first and second locking means and socket being dimensioned and positioned for axial locking engagement when the second ends are axially displaced together such that only the endmost second locking means can be locking engaged with the socket in a first locking mode, the second locking means being dimensioned relative to a reduced thickness section connecting the first and second locking means so that the second locking means is severable from the locked first locking means in response to a separation force on the second ends to place the first locking means in the terminal endmost position and permit the first locking means to then engage the socket in a second subsequent locking mode; and stop means secured to at least one of said legs for precluding engagement of the first locking means with the socket while the second locking means is in the endmost position.

16. The seal of claim 15 wherein the socket has a cavity for receiving a locking means in the locking engagement, the socket including a stop wall in the cavity for abutting the received second locking means to preclude locking engagement of the first locking means.

17. The seal of claim 15 wherein the stop means includes a flange member having first and second positions and being secured to the at least one leg, the flange being arranged to abut the other leg in the first flange position when the first and second legs are pushed toward each other and the second locking means is in locking engagement in the socket, said flange being arranged to be displaced to a second flange position to permit the first locking means to enter the socket in locking engagement therewith after the second locking means is severed.

18. The seal of claim 15 wherein the second locking means is secured to the first locking means and the first locking means is secured to the second end of the other leg such that in response to a force on the second locking means in the axial direction to disengage the locked second locking means from the locking engagement, only the second locking means severs.

* * * * *